United States Patent [19]

Pedroli

[11] 4,325,624

[45] Apr. 20, 1982

[54] SELF-DEVELOPING TYPE FILM PROCESSOR KIT

[75] Inventor: Walter E. Pedroli, Lexington, Mass.

[73] Assignee: Polaroid Corporation, Cambridge, Mass.

[21] Appl. No.: 183,014

[22] Filed: Sep. 2, 1980

[51] Int. Cl.[3] ..... G03D 5/02; G03D 5/06

[52] U.S. Cl. ..... 354/304; 354/318

[58] Field of Search ..... 354/301, 275, 303, 304, 354/305, 313, 314, 317, 318, 84–93; 430/404; 352/130

[56] References Cited

U.S. PATENT DOCUMENTS

| | | | |
|---|---|---|---|
| 3,228,767 | 1/1966 | Land | 354/93 |
| 3,282,695 | 11/1966 | Narodny | 430/404 |
| 3,405,619 | 10/1968 | Land | 354/84 |
| 3,608,465 | 9/1971 | Ching | 430/404 |
| 3,640,204 | 2/1972 | Gordon | 354/318 |
| 3,667,361 | 6/1972 | Meggs | 354/318 |
| 3,680,462 | 8/1972 | Cronig | 430/404 |
| 3,809,465 | 5/1974 | Mason | 352/130 |
| 4,145,133 | 3/1979 | Wareham | 354/83 |
| 4,200,383 | 4/1980 | Bendoni et al. | 354/304 |
| 4,212,527 | 7/1980 | Fischer | 354/275 |

OTHER PUBLICATIONS

Research Disclosure, Number 19219, pp. 132–134, Apr. 1980, Hutchinson & Reitter.

*Primary Examiner*—L. T. Hix
*Assistant Examiner*—Alan Mathews
*Attorney, Agent, or Firm*—Alfred E. Corrigan

[57] ABSTRACT

A processing kit for use in conjunction with an exposed roll of self-developing or instant type film, preferably of the transparency type. The kit includes a housing having a compartment for receiving a roll of flexible sheet material and a reservoir in which is located a container of liquid. The kit is adapted to be placed, as is, within a film processor, and a free end of the sheet, which initially protrudes from the kit, is attached to a take-up reel which, in turn, has an end of an exposed strip of self-developing type film attached thereto. Upon closing a loading door of the film processor, the container of liquid is ruptured and the take-up reel is driven in a manner so as to wind the sheet and film upon the take-up reel. As the sheet is being withdrawn from the kit, it is coated with the liquid and then brought into engagement with the film being wound on the reel so as to initiate the formation of visible images within adjacent sections of the film. After a predetermined period of time, the sheet and developed film are rewound into their original containers and the kit is then discarded.

22 Claims, 5 Drawing Figures

SELF-DEVELOPING TYPE FILM PROCESSOR KIT

BACKGROUND OF THE INVENTION

1. Field of the Invention

This invention relates to a kit which is adapted to be placed in a processor for use in developing an exposed roll of photographic film.

2. Description of the Prior Art

Lately, the versatility of conventional still cameras, e.g., of the 35 mm type, has been enhanced by the introduction of film assemblages of the type including a supply of self-developing or instant type film. For example, U.S. Pat. No. 3,667,361 describes a film assemblage which includes a film cassette containing a supply of instant type film and a reservoir containing a supply of developing solution. The film cassette is adapted for use in a conventional still camera wherein the film is advanced in a first direction so as to expose successive frames. After the last frame has been exposed, the film is moved in an opposite direction. This latter movement is effective to remove a seal from the reservoir thereby permitting a coating of the developing solution to be applied to the film as the latter is advanced past the reservoir. After the processing of the film has been completed, the film cassette is removed from the camera and the processed film is then removed from the film cassette. Still further examples of film assemblages containing self-developing or instant type film which are specifically adapted for use in conventional still cameras of the 35 mm type may be found in U.S. Pat. Nos. 4,200,383, 4,145,133 and 4,212,527 and on pages 132–134 of the April 1980 issue of RESEARCH DISCLOSURE.

One feature that is common to the above-described film assemblages is that the container of processing liquid is a part of the film assemblage. While there may be some advantages in so incorporating the container into the film assemblage, there are also some disadvantages. For example, if the container of processing liquid were to break or leak prior to the processing of the film, then the entire film assemblage may be rendered useless and/or parts of the camera may be damaged. Further, if the shelf life of a film assemblage is determined by the age of the processing liquid, vis-a-vis the film, then it would be advantageous to be able to buy a fresh supply of processing liquid at the time that it is needed to process an exposed roll of film rather than have it as an aged element of the original film assemblage. Although the idea of keeping the container of processing liquid separate from the film assemblage is old, as evidenced by U.S. Pat. No. 3,228,767, it has not been incorporated into a kit of the type to be described hereinafter.

SUMMARY OF THE INVENTION

The instant invention relates to a kit which is especially adapted to be loaded, as is, into a film processor wherein it will be used to develop an exposed roll of self-developing or instant film, preferably of the transparency type.

The kit includes a rectangularly shaped card which functions as a support for a housing. The housing includes a chamber for receiving a spool upon which is coiled a supply of flexible sheet material. The housing also includes a reservoir containing a rupturable container of processing liquid. An enclosure is mounted in surrounding relation to the housing and has a peripheral flange extending horizontally therefrom which is adapted to be secured to the peripheral edge of the card to thereby form a "blister pack" which may be conveniently hung from a display board in a store. The spool includes a pair of annular flanges which are located at opposite ends of the spool. The spool is adapted to be rotatively supported within the chamber such that a portion of the peripheral edge of each flange protrudes through adjacent slots in the card such that they may be located exteriorly of the kit. Further, one end of the flexible sheet material extends from the chamber to a location between the card and the bottom of the reservoir, whereat a coating of processing liquid is adapted to be applied to one side of the sheet, and then to the exterior of the kit via a slot defined by a portion of the peripheral flange of the enclosure and the card.

As stated above, the kit is adapted to be placed in a film processor, as is, i.e., in the same condition it was in when it was originally purchased. The end of the sheet material which protrodes from the kit is partially withdrawn and attached to a take-up reel. A film casseette containing an exposed strip of film is placed in an opposite end of the processor and the free end of the film is also attached to the take-up reel. Next, the door of the processor is closed to lighttight the processor and suitable means are activated to rupture the container of processing liquid and to drive the take-up reel. Rotation of the take-up reel is effective to withdraw the flexible sheet material from the kit and the film from the cassette while simultaneously winding the two in face-to-face relation upon the reel. As the flexible sheet material is being withdrawn from the kit, a coating of processing liquid is applied to one side thereof by a nozzle or the like in the bottom of the reservoir. In a preferred embodiment of the invention, the coated surface of the flexible sheet material is brought into engagement with the surface of the film which is opposite to that through which the film was photographically exposed and thereafter wound upon the take-up reel. The processing liquid on the flexible sheet material is imbibed by the adjacent surface of the film and initiates the formation of a visible image within the film. The take-up reel is stopped after the photographically exposed area of the film strip has been wound upon the take-up reel in superadjacency with the sheet material. After a predetermined period of time sufficient for the processing of the film to become substantially completed, e.g., one minute, a reel in the film cassette is driven to rewind the film into the cassette. Simultaneously therewith a drive wheel is rotated in engagement with the exposed peripheral portions of the flanges of the sheet material spool so as to completely rewind the sheet material onto the spool. The caustic materials, if any, which may be in the processing liquid are now located completely within the kit and the latter may now be safely disposed of. In an alternative embodiment of the invention, the film is comprised of a photosensitive layer through which the film is exposed and an underlying base layer while the flexible sheet material includes a transparent base layer and an underlying image receiving layer. The processing liquid is coated upon the side of the sheet material which is opposite to its transparent base layer and this coated surface is brought into engagement with the surface of the film through which the film was exposed. After processing on the take-up reel, the two, i.e., the sheet and film, are rewound into their respective chambers. The visible positive images now appear on the sheet material and thus it may be removed from the kit prior to its disposal.

An object of the invention is to provide a kit which is adapted to be used, as is, in a processor, so as to produce visible images in a roll of exposed film.

Another object of the invention is to provide a processing kit which includes a supply of flexible sheet material which is adapted to be coated with a processing liquid and then superposed with a strip of exposed self-developing type film so as to produce visible images in either the sheet material or the exposed strip of film.

Still another object of the invention is to provide a processing kit with means for supporting the kit on a display board and for supporting and aligning the kit within a film processor.

Other objects of the invention will in part be obvious and will in part appear hereinafter.

The invention accordingly comprises the apparatus possessing the construction, combination of elements and arrangement of parts which are exemplified in the following detailed disclosure, and the scope of the application of which will be indicated in the claims.

BRIEF DESCRIPTION OF THE DRAWINGS

For a fuller understanding of the nature and objects of the invention, reference should be had to the following detailed description taken in consideration with the accompanying drawings wherein.

DETAILED DESCRIPTION OF THE INVENTION

Figure 1:
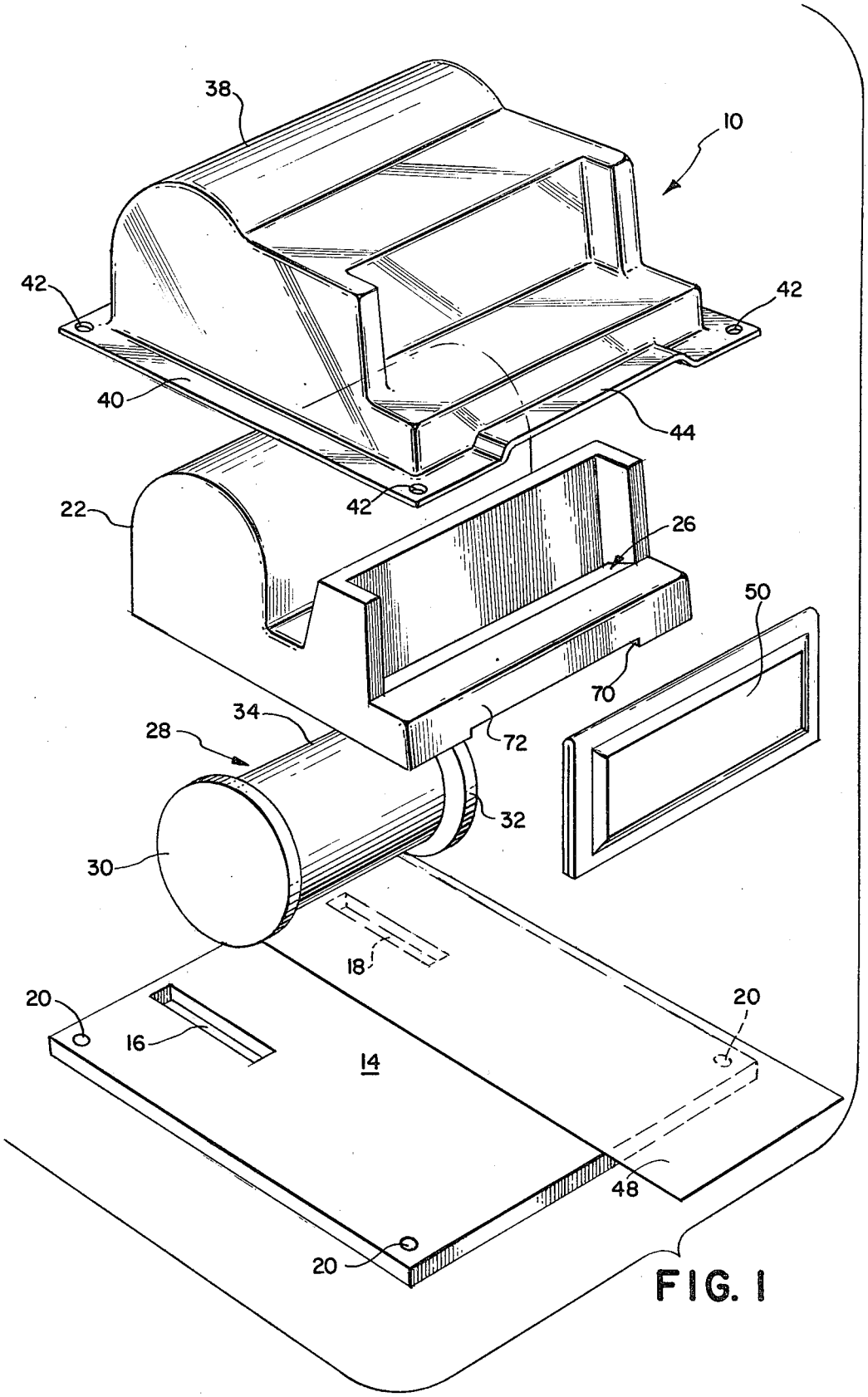
FIG. 1 is a an exploded perspective view of a processing kit which comprises the instant invention.
Figure 2:
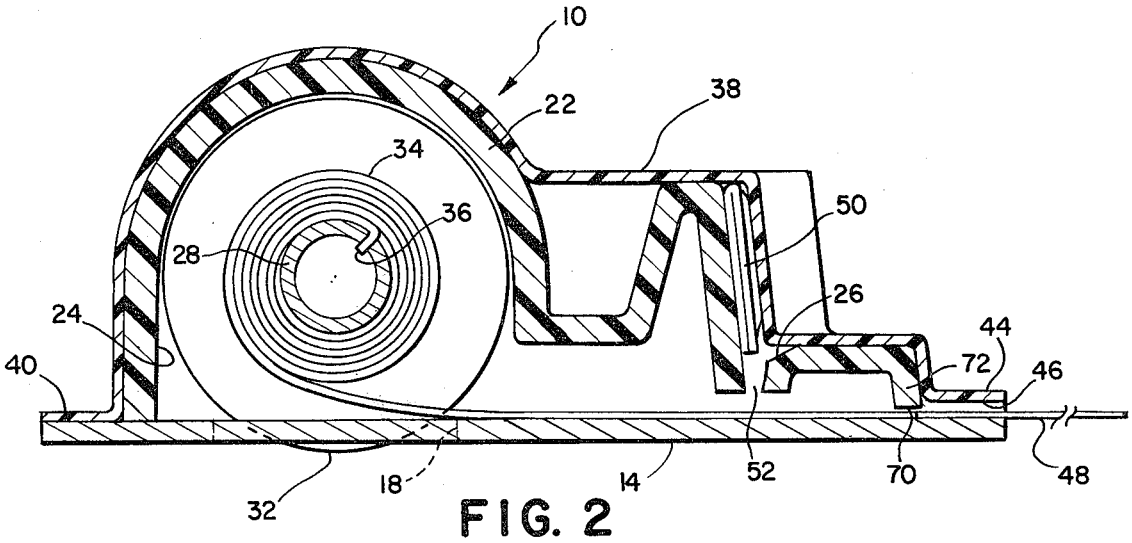
FIG. 2 is a cross-sectional elevational view of the processing kit.
Figure 3:
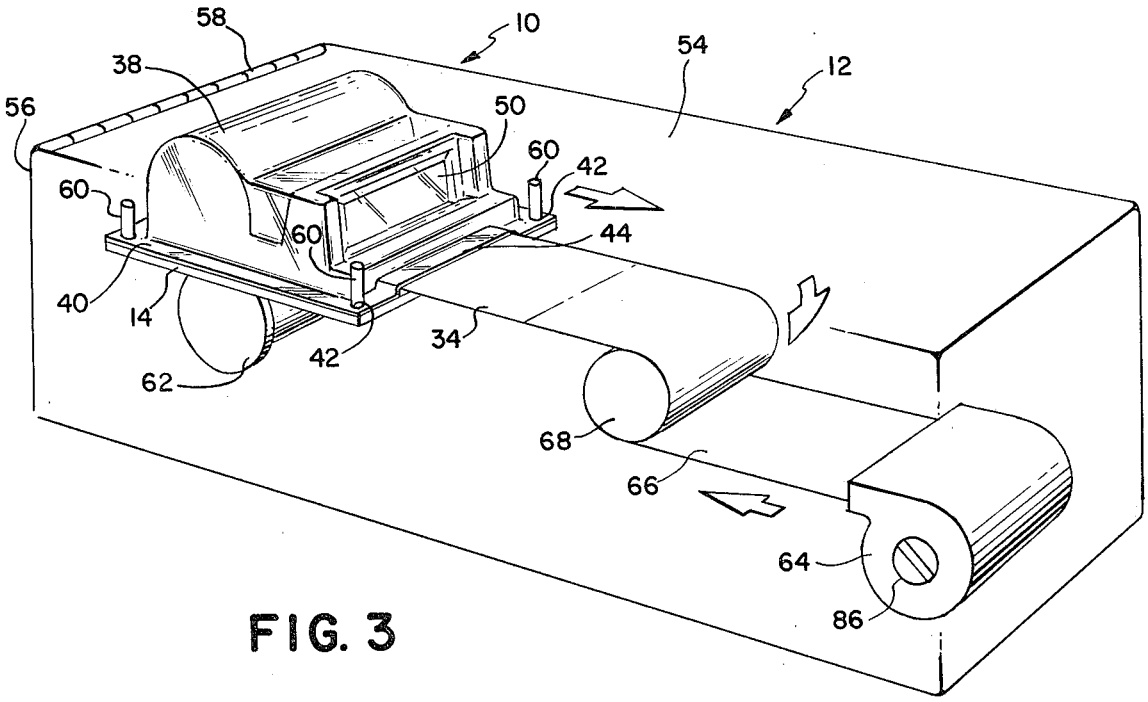
FIG. 3 is a schematic representative of the processing kit located within a film processor.

Reference is now made to FIGS. 1 and 2 of the drawings wherein is shown a preferred embodiment of a kit 10 which is adapted to be placed, as is, within a film processor 12 (shown diagrammatically in FIG. 3). The kit 10 includes a support member 14 having a pair of laterally spaced slots 16 and 18 therein and an aperture 20 at each corner of the support member 14. A housing 22 having a chamber 24 and a reservoir 26 is adapted to be supported by the member 14, as shown in FIG. 2. The chamber 24 is constructed to rotatably support a spool 28 having an annular flange 30 and 32 located at opposite ends thereof. The diameters of the annular flanges 30 and 32 are identical and are of a size which permits a portion of their periphery to extend through the slots 16 and 18 to the exterior of the kit 10. An elongate strip of flexible sheet material 34 has one of its ends 36 secured within a slot in the spool 28 and is wound upon the spool. A rupturable container 50 of processing liquid is adapted to be located in the reservoir 26 with its rupturable end facing downwardly towards a transversely extending slot 52 in the bottom of the reservoir 26. The slot 52 has a length at least equal to the width of the sheet material 34. The kit 10 further includes an enclosure 38 formed from any suitable flexible material and a configuration similar to that of the housing 22. The bottom edge of the enclosure 38 is flared outwardly so as to define a peripheral flange 40 which extends horizontally outwardly from the main body of the enclosure 38. The peripheral flange 40 includes an aperture 42 at each of its four corners and a raised section 44 which is adapted to cooperate with the support member 14 to define an opening 46 through which an end 48 of the flexible sheet material 34 may extend to the exterior of the kit 10. The flange 40 is adapted to be secured to the horizontal peripheral edges of the support member 14 by any suitable means with the apertures 42 located in alignment with the apertures 20 in the support member 14. As assembled, the kit 10 takes on the appearance of the typical "blister pack" commonly found in today's department stores and as such may be hung upon a display board by means of the apertures 20 and 42.

The kit 10 is adapted to be used, as is, in the film processor 12, shown schematically in FIG. 3. The processor 12 includes a top wall 54 which is pivotally mounted to an end wall 56 by a hinge 58. The kit 10 is adapted to be placed within the processor 12 and supported and aligned in position by a plurality of vertical posts 60 which extend upwardly through the apertures 20 and 42 in the four corners of the kit 10. So positioned, the exteriorly located portions of the annular flanges 30 and 32 of the spool 28 are located in engagement with a drive or friction roller 62 which, in turn, is suitably mounted for rotation within the processor 12. The opposite end of the processor 12 is provided with suitable means (not shown) for supporting a film cassette 64, preferably of the configuration of a standard 35 mm cassette, containing an exposed strip of film 66.

In the processing of the film 66, one end of the film 66 is attached to one side of a processing drum or take-up reel 68 and the end 48 of the sheet material 34 is attached to the opposite side of the take-up reel 68, as shown in FIG. 3. The cover or loading door 54 is then closed thereby activating suitable means (not shown) which (1) function to press against the enclosure 38 at a point adjacent the container 50 to thereby rupture the latter, and (2) to drive the take-up reel 68 in a clockwise direction. The rotation of the take-up reel 68 functions to simultaneously withdraw the sheet material 34 and the film 66 from their respective containers while simultaneously wrapping or winding them in overlying relation upon the take-up reel 68. As the sheet material 34 is being withdrawn from the chamber 24, it passes beneath the slot 52 in the reservoir 26 whereat a coating of processing liquid is applied to the upper side of the sheet material 34. As the coated surface of the sheet material 34 approaches the exit slot 46 in the kit 10, it passes through a recessed section 70 in a forward wall 72 of the enclosure 38. The recessed section 70 in conjunction with the support member 14 functions to control the maximum thickness of the coating of processing liquid upon the sheet material 34. After the entire exposed portion of the film 66 has been wound upon the take-up reel 68, rotation of the latter is stopped and the superposed sheets, i.e., the sheet material 34 and the film 66, are maintained in the darkness of the processor 12 for a predetermined period of time, e.g., one minute, sufficient to allow the formation of visible images in one of the two sheets.

Figure 4A:
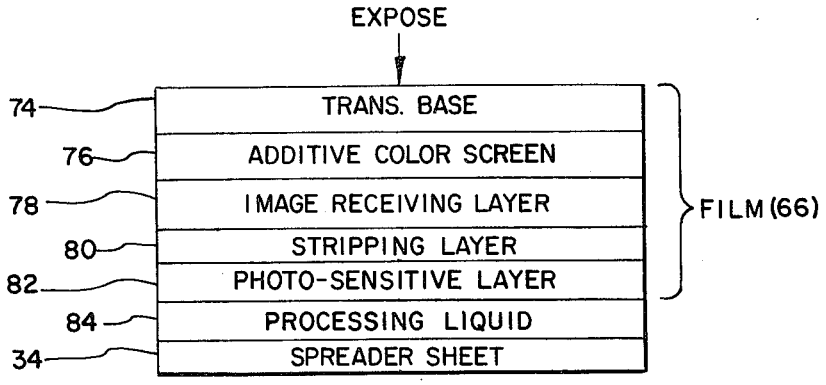
FIG. 4*a* is a diagrammatic enlarged cross-sectional view of a strip of film superposed with a flexible sheet material during the processing of the film.
Figure 4B:
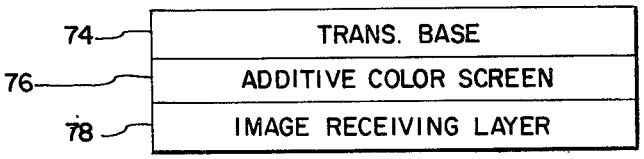
FIG. 4*b* is a view similar to FIG. 4*a* showing the film after it has been separated from the flexible sheet material.

In a preferred embodiment of the invention, the film 66 basically takes the form shown in FIG. 4*a*. The film 66 includes a plurality of layers including, in sequence, a transparent base 74 through which an exposure is made, an additive color screen 76, an image receiving layer 78, a stripping layer 80, and a photosensitive layer 82. It will be noted from FIG. 3 that as the sheet material or spreader sheet 34 and the film 66 are brought into contact with each other at the take-up reel, it is the layer of the film unit 66 which is most distant from the transparent base 74 that is placed in intimate contact with the surface of the sheet material 34 having the processing liquid 84 coated thereon. At the end of the predetermined period of time, the roller 62 is driven in a counterclockwise direction to thereby rewind the sheet material back onto the spool 28. Simultaneously therewith, a drive (not shown) is applied to a spool 86 of the film cassette 64 to rewind the film upon the spool 86. Subsequent to processing, the photosensitive layer exhibits a greater adhesion to the spreader sheet 34 than to the next adjacent layers whereby removal of the spread sheet 34 serves to remove the photosensitive layer 82 thus increasing visual acuity and brightness of the resultant transparency, shown in FIG. 4*b*, and ehancing its stability by virtue of the removal of residual processing reagent in the photosensitive layer 82. In a particularly preferred embodiment, the stripping layer 80 is employed to facilitate removal of the photosensitive layer 82. For further details of the film, reference may be had to U.S. Pat. No. 3,682,637 granted to E. H. Land on Aug. 8, 1972. After the sheet material or spreader sheet 34 has been completely rewound upon the spool 28, the kit 10 may be safely discarded since any caustic materials will be fully enclosed within the kit 10. The developed strip of film 66 may then be removed from the film cassette 64 and the individual frames cut and mounted for subsequent viewing.

In an alternative embodiment, the visible images will be formed in the spreader sheet 34. Accordingly, the film 66 would be comprised of a photosensitive layer through which the exposure would be made and a base which may or may not be transparent. Also, the spreader sheet 34 would be comprised of a transparent base and an image receiving layer. Subsequent to the exposure of the film, the side of the spreader sheet 34 containing the image receiving layer would be coated with the processing liquid and brought into engagement with the side of the film through which the exposure had been made. After the spreader sheet had been returned to the kit, it would be removed and the individual scenes cut and mounted for subsequent viewing. Since certain changes may be made in the above apparatus without departing from the scope of the invention herein involved, it is intended that all matter contained in the above description or shown in the accompanying drawings shall be interpreted as illustrative and not in a limiting sense. For example, while the invention has been described as one wherein a positive transparency has been obtained, the invention applied equally as well to reflection type prints.

What is claimed is:

1. A kit adapted for use in a film processor wherein it is adapted for use with an exposed roll of instant type film to initiate the formation of visible images in the film, comprising:

means for housing a supply of flexible sheet material, means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit; and a supply of flexible sheet material supported within said housing with one free end of said sheet material extending between said supporting means and said reservoir, whereat a coating of said processing liquid is adapted to be applied to said sheet material, and then to the outside of said kit via said opening, whereby said free end may be used to progressively withdraw said sheet material from said kit in a coated condition such that it may be superposed with an exposed strip of photographic film so as to initiate the formation of visible images in the film.

2. A kit as defined in claim 1 wherein said sheet material is originally coiled within said housing.

3. A kit as defined in claim 2 further including a spool upon which said sheet material is wound with one end secured thereto such that said spool may be rotated in a direction to rewind said sheet material thereon subsequent to the processing of the exposed strip of photographic film.

4. A kit as defined in claim 3 further including means for defining a plurality of apertures in said supporting means and said enclosing means to enable said kit to be hung from a display board.

5. A kit as defined in claim 4 wherein said apertures are further adapted to receive means in the processor for aligning and supporting the kit within the processor.

6. A kit as defined in claim 4 wherein said kit is constructed to be used in the processor in the same condition that it was in when hung from the display board.

7. A kit as defined in claim 3 wherein said supply of processing liquid is located within a rupturable container.

8. A kit as defined in claim 3 wherein said reservoir includes a liquid dispensing slot for directing said processing liquid onto said sheet material.

9. A kit as defined in claim 3 further including means for controlling the thickness of the coating of said processing liquid on said sheet material.

10. A kit including a supply of flexible sheet material adapted for use in a film processor wherein it is adapted for use with an exposed roll of instant type film to initiate the formation of visible images in the sheet material, comprising:

means for housing a supply of flexible sheet material;

means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit; and a supply of flexible sheet material supported within said housing with one free end of said sheet material extending between said supporting means and said reservoir, whereat a coating of said processing liquid is adapted to be applied to said sheet material, and then to the outside of said kit via said opening, whereby said free end may be used to progressively withdraw said sheet material from said kit in a coated condition such that it may be superposed with an exposed strip of photographic film so as to initiate the formation of visible images in said sheet material.

11. A kit as defined in claim 10 wherein said sheet material is originally coiled within said housing.

12. A kit as defined in claim 11 further including a spool upon which said sheet material is wound.

13. A kit as defined in claim 10 further including means for defining a plurality of apertures in said supporting means and said enclosing means to enable said kit to be hung from a display board.

14. A kit as defined in claim 13 wherein said apertures are further adapted to receive means in the processor for aligning and supporting the kit within the processor.

15. A kit as defined in claim 13 wherein said kit is constructed to be used in the processor in the same condition that it was in when hung from the display board.

16. A kit as defined in claim 10 wherein said supply of processing liquid is located within a rupturable container.

17. A kit as defined in claim 10 wherein said reservoir includes a liquid dispensing slot for directing said processing liquid onto said sheet material.

18. A kit as defined in claim 10 further including means for controlling the thickness of the coating of said processing liquid on said sheet material.

19. A kit adapted for use in a film processor wherein it is adapted for use with an exposed roll of instant type film to initiate the formation of visible images in the film, comprising:

means for housing a supply of flexible sheet material;

means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit;

a spool having a supply of flexible sheet material coiled thereabout, said spool being supported within said housing with one free end of said sheet material extending between said supporting means and said reservoir, whereat a coating of said processing liquid is adapted to be applied to said sheet material, and then to the outside of said kit via said opening, whereby said free end may be used to progressively withdraw said sheet material from said kit in a coated condition such that it may be superposed with an exposed strip of photographic film so as to initiate the formation of visible images in the film; and said supporting means includes a slot extending in a direction transverse to the axis of said spool, and said spool includes an annular flange at one end thereof having a diameter sufficient to allow the peripheral edge thereof to extend through said slot to the exterior of said kit where it may be engaged and driven so as to rewind said sheet material upon said spool after processing of the film has been completed.

20. A kit adapted fo use in a film processor wherein it is adapted for use with an exposed roll of instant type film to initiate the formation of visible images in the film, comprising:

means for housing a supply of flexible sheet material;

means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit;

a spool having a supply of flexible sheet material coiled thereabout, said spool being supported within said housing with one free end of said sheet material extending between said supporting means and said reservoir, whereat a coating of said processing liquid is adapted to be applied to said sheet material, and then to the outside of said kit via said opening, whereby said free end may be used to progressively withdraw said sheet material from said kit in a coated condition such that it may be superposed with an exposed strip of photographic film so as to initiate the formation of visible images in the film; and said supporting means includes a pair of laterally spaced slots which extend in a direction transverse to the axis of said spool, and said spool includes an annular flange at opposite ends thereof, each said flange having a diameter sufficient to allow the peripheral edge thereof to extend to the exterior of said kit where it may be engaged and driven so as to rewind said sheet material upon said spool after processing of the film has been completed.

21. A kit including a supply of flexible sheet material adapted for use in a film processor wherein it is adapted for use with an exposed roll of instant type film to initiate the formation of visible images in the sheet material, comprising:

means for housing a supply of flexible sheet material;

means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit;

a spool having a supply of flexible sheet material coiled thereabout, said spool being supported within said housng with one free end of said sheet material extending between said supporting means and said reservoir, whereat a coating of said processing liquid is adapted to be applied to said sheet material, and then to the outside of said kit via said opening, whereby said free end may be used to progressively withdraw said sheet material from said kit in a coated condition such that it may be superposed with an exposed strip of photographic film so as to initiate the formation of visible images in said sheet material; and said supporting means includes a slot extending in a direction transverse to the axis of said spool, and said spool includes an annular flange at one end thereof having a diameter sufficient to allow the peripheral edge thereof to extend through said slot to the exterior of said kit where it may be engaged and driven so as to rewind said sheet material upon said spool after processing of said sheet material and the film has been completed.

22. A kit including a supply of flexible sheet material adapted for use in a film processor wherein it is adapted for use with an exposed roll of instant type film to initiate the formation of visible images in the sheet material, comprising:

means for housing a supply of flexible sheet material;

means for defining a reservoir for containing a supply of processing liquid;

a supply of processing liquid located in said reservoir;

means for supporting said housing and said reservoir;

means for substantially enclosing said housing and said reservoir, said enclosing means cooperating with said supporting means to define an opening through which an end of a flexible sheet material may extend to the exterior of said kit;

a spool having a supply of flexible sheet material coiled thereabout, said spool being supported within said housing with one free end of said sheet material extending between said supporting means and said reservoir, whereat a coating of said processing liquid is adapted to be applied to said sheet material, and then to the outside of said kit via said openings, whereby said free end may be used to progressively withdraw said sheet material from said kit in a coated condition such that it may be superposed with an exposed strip of photographic film so as to initiate the formation of visible images in said sheet material; and said supporting means includes a pair of laterally spaced slots which extend in a direction transverse to the axis of said spool, and said spool includes an annular flange at opposite ends thereof, each said flange having a diameter sufficient to allow the peripheral edge thereof to extend to the exterior of said kit where it may be engaged and driven so as to rewind said sheet material upon said spool after processing of said sheet material and the film has been completed.

* * * * *